US006248227B1

(12) United States Patent
de Nora et al.

(10) Patent No.: US 6,248,227 B1
(45) Date of Patent: Jun. 19, 2001

(54) SLOW CONSUMABLE NON-CARBON METAL-BASED ANODES FOR ALUMINIUM PRODUCTION CELLS

(75) Inventors: Vittorio de Nora, Nassau (BS); Jean-Jacques Duruz, Geneva (CH)

(73) Assignee: Moltech Invent S.A. (LU)

( * ) Notice: Subject to any disclaimer, the term of this patent is extended or adjusted under 35 U.S.C. 154(b) by 0 days.

(21) Appl. No.: 09/126,205

(22) Filed: Jul. 30, 1998

(51) Int. Cl.[7] ..... C25C 3/00; C25C 3/08; C25C 3/12

(52) U.S. Cl. ..... 205/230; 205/383; 205/384; 205/387; 204/243.1; 204/244; 204/245; 204/247.3; 204/290.01; 204/290.12; 204/290.13; 204/293; 204/247

(58) Field of Search ..... 204/290.01, 290.13, 204/280, 244, 245, 243.1, 247.3, 290.12, 293, 247; 205/387, 230, 380, 383, 384

(56) References Cited

U.S. PATENT DOCUMENTS 3,718,550 * 2/1973 Klein ..... 205/387
3,974,046 * 8/1976 Alder ..... 205/387 X
4,552,630 * 11/1985 Wheeler et al. ..... 205/387
4,614,569 * 9/1986 Duruz et al. ..... 205/387 X
4,956,068 * 9/1990 Nguyen et al. ..... 204/290.13 X
5,286,359 * 2/1994 Richards et al. ..... 204/244 X
5,510,008 4/1996 Sekhar et al. .

* cited by examiner

*Primary Examiner*—Donald R. Valentine
(74) *Attorney, Agent, or Firm*—Jayadeep R. Deshmukh

(57) ABSTRACT

A non-carbon, metal-based slow-consumable anode of a cell for the electrowinning of aluminium self-forms during normal electrolysis an electrochemically-active oxide-based surface layer (20). The rate of formation (35) of the layer (20) is substantially equal to its rate of dissolution (30) at the surface layer/electrolyte interface (25) thereby maintaining its thickness substantially constant, forming a limited barrier controlling the oxidation rate (35). The anode (10) usually comprises an alloy of iron with at least one of nickel, copper, cobalt or zinc which during use forms an oxide surface layer (20) mainly containing ferrite.

29 Claims, 2 Drawing Sheets

SLOW CONSUMABLE NON-CARBON METAL-BASED ANODES FOR ALUMINIUM PRODUCTION CELLS

FIELD OF THE INVENTION

This invention relates to non-carbon, metal-based, slow consumable anodes for use in cells for the electrowinning of aluminium by the electrolysis of alumina dissolved in a molten fluoride-containing electrolyte, and to methods for their fabrication and reconditioning, as well as to electrowinning cells containing such anodes and their use to produce aluminium.

BACKGROUND ART

The technology for the production of aluminium by the electrolysis of alumina, dissolved in molten cryolite, at temperatures around 950° C. is more than one hundred years old.

This process, conceived almost simultaneously by Hall and Héroult, has not evolved as many other electrochemical processes.

The anodes are still made of carbonaceous material and must be replaced every few weeks. The operating temperature is still not less than 950° C. in order to have a sufficiently high solubility and rate of dissolution of alumina and high electrical conductivity of the bath.

The carbon anodes have a very short life because during electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

The frequent substitution of the anodes in the cells is still a clumsy and unpleasant operation. This cannot be avoided or greatly improved due to the size and weight of the anode and the high temperature of operation.

Several improvements were made in order to increase the lifetime of the anodes of aluminium electrowinning cells, usually by improving their resistance to chemical attacks by the cell environment and air to those parts of the anodes which remain outside the bath. However, most attempts to increase the chemical resistance of anodes were coupled with a degradation of their electrical conductivity.

U.S. Pat. No. 4,614,569 (Duruz et al.) describes anodes for aluminium electrowinning coated with a protective coating of cerium oxyfluoride, formed in-situ in the cell or pre-applied, this coating being maintained by the addition of cerium to the molten cryolite electrolyte. This made it possible to have a protection of the surface only from the electrolyte attack and to a certain extent from the gaseous oxygen but not from the nascent monoatomic oxygen.

EP Patent application 0 306 100 (Nyguen/Lazouni/ Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer.

Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective barrier layer. However, full protection of the alloy substrate was difficult to achieve.

A significant improvement described in U.S. Pat. No. 5,510,008, and in International Application WO96/12833 (Sekhar/Liu/Duruz) involved micropyretically producing a body from nickel, aluminium, iron and copper and oxidising the surface before use or in-situ. By said micropyretic methods materials have been obtained whose surfaces, when oxidised, are active for the anodic reaction and whose metallic interior has low electrical resistivity to carry a current from high electrical resistant surface to the busbars. However it would be useful, if it were possible, to simplify the manufacturing process of these materials and increase their life to make their use economic.

Metal or metal-based anodes are highly desirable in aluminium electrowinning cells instead of carbon-based anodes. As described hereabove, many attempts were made to use metallic anodes for aluminium production, however they were never adopted by the aluminium industry because of their poor performance.

OBJECTS OF THE INVENTION

An object of the present invention is to provide a non-carbon, metal-based anode for the electrowinning of aluminium so as to eliminate carbon-generated pollution and reduce the frequency of anode replacement, such an anode having an outside layer well resistant to chemical electrolyte attack whose surface is electrochemically active for the oxidation of oxygen ions contained in the electrolyte and for the formation of gaseous oxygen.

A further object of the invention is to provide a metal-based anode capable of generating during normal electrolysis at its surface an electrochemically active oxide layer which slowly and progressively dissolves into the electrolyte.

A major object of the invention is to provide an anode for the electrowinning of aluminium which has no carbon so as to eliminate carbon-generated pollution and reduce the high cell voltage.

SUMMARY OF THE INVENTION

The invention relates to a non-carbon, metal-based slow-consumable anode of a cell for the electrowinning of aluminium by the electrolysis of alumina dissolved in a molten fluoride-based electrolyte. The anode self-forms during normal electrolysis an electrochemically-active oxide-based surface layer, the rate of formation of said layer being substantially equal to its rate of dissolution at the surface layer/electrolyte interface thereby maintaining its thickness substantially constant forming a limited barrier controlling the oxidation rate.

In this context, metal-based anode means that the anode contains at least one metal as such or as an alloy, intermetallic and/or cermet.

During normal operation, the anode thus comprises a metallic (un-oxidised) anode body (or layer) on which and from which the oxide-based surface layer is formed.

The electrochemically active oxide-based surface layer may contain an oxide as such, or in a multi-compound mixed oxide and/or in a solid solution of oxides. The oxide may be in the form of a simple, double and/or multiple oxide, and/or in the form of a stoichiometric or non-stoichiometric oxide.

The oxide-based surface layer has several functions. Besides protecting in some measure the metallic anode body against chemical attack in the cell environment and its electrochemical function for the conversion of oxygen ions to molecular oxygen, the oxide-based surface layer controls the diffusion of oxygen which oxidises the anode body to further form the surface layer.

When the oxide-based surface layer is too thin, in particular at the start-up of electrolysis, the diffusion of oxygen towards the metallic body is such as to oxidise the metallic anode body at the surface layer/anode body interface with formation of the oxide-based surface layer at a faster rate than the dissolution rate of the surface layer into the electrolyte, allowing the thickness of the oxide-based surface layer to increase. The thicker the oxide-based surface layer becomes, the more difficult it becomes for oxygen to reach the metallic anode body for its oxidation and therefore the rate of formation of the oxide-based surface layer decreases with the increasing thickness of the surface layer. Once the rate of formation of the oxide-based surface layer has met its rate of dissolution into the electrolyte an equilibrium is reached at which the thickness of the surface layer remains substantially constant and during which the metallic anode body is oxidised at a rate which substantially corresponds to the rate of dissolution of the oxide-based surface layer into the electrolyte.

In contrast to carbon anodes, in particular pre-baked carbon anodes, the consumption of the non-carbon, metal-based anodes according to the invention is at a very slow rate. Therefore, these slow consumable anodes in drained cell configurations do not need to be regularly repositioned in respect of their facing cathodes since the anode-cathode gap does not substantially change.

To practically realise the invention, the anode body can comprise an iron alloy which when oxidised will form an oxide-based surface layer containing a ferrite some of which adheres to the iron alloy, providing a good electrical conductivity and electrochemical activity, and a low dissolution rate in the electrolyte.

Optionally, the anode body may also comprise one or more additives selected from beryllium, magnesium, yttrium, titanium, zirconium, vanadium, niobium, tantalum, chromium, molybdenum, tungsten, manganese, rhodium, silver, aluminium, silicon, tin, hafnium, lithium, cerium and other Lanthanides.

Advantageously, the anode comprises cerium which is oxidised to ceria in the formation of the oxide-based surface layer to provide on the surface of the oxide-based surface layer a nucleating agent for in-situ formation of an electrolyte-generated protective layer. Such electrolyte-generated protective layer usually comprises cerium oxyfluoride when cerium ions are contained in the electrolyte and may be obtained by following the teachings of U.S. Pat. No. 4,614,569 (Duruz et al) which describes a protective anode coating of cerium oxyfluoride, formed in-situ in the cell or pre-applied, and maintained by the addition of small amounts of cerium to the molten electrolyte.

The oxide-based surface layer may alternatively comprise ceramic oxides containing combinations of divalent nickel, cobalt, magnesium, manganese, copper and zinc with divalent/trivalent nickel, cobalt, manganese and/or iron. The ceramic oxides can be in the form of perovskites or non-stoichiometric and/or partially substituted or doped spinels, the doped spinels further comprising dopants selected from the group consisting of $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$, and $Li^{+}$.

The anode can also comprise a metallic anode body or layer which progressively forms the oxide-based surface layer on an inert, inner core made of a different electronically conductive material, such as metals, alloys, intermetallics, cermets and conductive ceramics.

In particular, the inner core may comprise at least one metal selected from copper, chromium, nickel, cobalt, iron, aluminium, hafnium, molybdenum, niobium, silicon, tantalum, tungsten, vanadium, yttrium and zirconium, and combinations and compounds thereof. For instance, the core may consist of an alloy comprising 10 to 30 weight % of chromium, 55 to 90 weight % of at least one of nickel, cobalt and/or iron and up to 15 weight % of at least one of aluminium, hafnium, molybdenum, niobium, silicon, tantalum, tungsten, vanadium, yttrium and zirconium.

Resistance to oxygen may be at least partly achieved by forming an oxygen barrier layer on the surface of the inner core by surface oxidation or application of a precursor layer and heat treatment. Known barriers to oxygen are chromium oxide and black non-stoichiometric nickel oxide.

Advantageously, the oxygen barrier layer on the core may be covered with at least one protective layer consisting of copper, or copper and at least one of nickel and cobalt, and/or oxide(s) thereof to protect the oxygen barrier layer by inhibiting its dissolution into the electrolyte.

The invention also relates to a method of producing such anodes. The method comprises immersing an anode with an oxide-free or pre-oxidised surface into a molten fluoride-containing electrolyte and self-forming or growing an electrochemically active oxide-based surface layer as described hereabove.

An anode according to the invention can be restored when the metallic anode body or layer is worn and/or damaged. The method for restoring the anode comprises clearing and cleaning at least the worn and/or damaged parts of the anode; reconstituting the anode and optionally pre-oxidising the surface of the anode; immersing it into a molten fluoride-containing electrolyte; and self-forming or growing an electrochemically active oxide-based surface layer as described above.

A further aspect of the invention is a cell and a method for the electrowinning of aluminium comprising at least one anode which during normal electrolysis is oxidised, self-forming the electrochemically active oxide-based surface layer as described above.

Preferably, the cell comprises at least one aluminium-wettable cathode. Even more preferably, the cell is in a drained configuration by having at least one drained cathode on which aluminium is produced and from which aluminium continuously drains.

The cell may be of monopolar, multi-monopolar or bipolar configuration. A bipolar cell may comprise the anodes as described above as a terminal anode or as the anode part of a bipolar electrode.

Preferably, the cell comprises means to improve the circulation of the electrolyte between the anodes and facing cathodes and/or means to facilitate dissolution of alumina in the electrolyte. Such means can for instance be provided by the geometry of the cell as described in co-pending application PCT/IB98/00161 (de Nora/Duruz) or by periodically moving the anodes as described in co-pending application PCT/IB98/00162 (Duruz/Bello).

The cell may be operated with the electrolyte at conventional temperatures, such as 950 to 970° C., or at reduced temperatures as low as 700° C.

The invention also relates to a method of producing aluminium in a cell for the electrowinning of aluminium. The method comprises immersing a metallic anode having an oxide-free or a pre-oxidised surface into a molten fluoride-containing electrolyte, self-forming an electrochemically active oxide-based surface layer as described hereabove, and then electrolysing the dissolved alumina to produce aluminium in the same or a different fluoride-based electrolyte.

The surface of the anode may be in-situ or ex-situ pre-oxidised, for instance in air or in another oxidising atmosphere or media, or it may be oxidised in a first electrolytic cell and then transferred into an aluminium production cell.

Another aspect of the invention is an anode comprising an oxide-free or a pre-oxidised surface which when (further) oxidised during cell operation as described above gives origin to the above described self-formed, electrochemically active oxide-based surface layer.

When the anode has a pre-oxidised surface layer which is thicker than its thickness during normal operation, the rate of formation of the oxide-based surface layer is initially less than its rate of dissolution but increases to reach it. Conversely, when the anode has an oxide-free surface or a pre-oxidised surface forming an oxide-based layer which is thinner than its thickness during normal operation, the rate of formation of the oxide-based surface layer is initially greater than its rate of dissolution but decreases to reach it.

The pre-oxidised surface layer may be of such a thickness that after immersion into the electrolyte and during electrolysis the thick oxide-based surface layer prevents the penetration of nascent monoatomic oxygen beyond the oxide-based surface layer. Therefore the mechanism for forming new oxide by further oxidation of the anode is delayed until the existing pre-oxidised surface layer has been sufficiently dissolved into the electrolyte at the surface layer/electrolyte interface, no longer forming a barrier to nascent oxygen.

Anodes made according to the invention when worn can be replaced during normal use of a cell with new anodes or restored anodes.

BRIEF DESCRIPTION OF THE DRAWINGS

Reference is made to the drawings wherein.

DETAILED DESCRIPTION

Figures 1A, 1B, 1C:
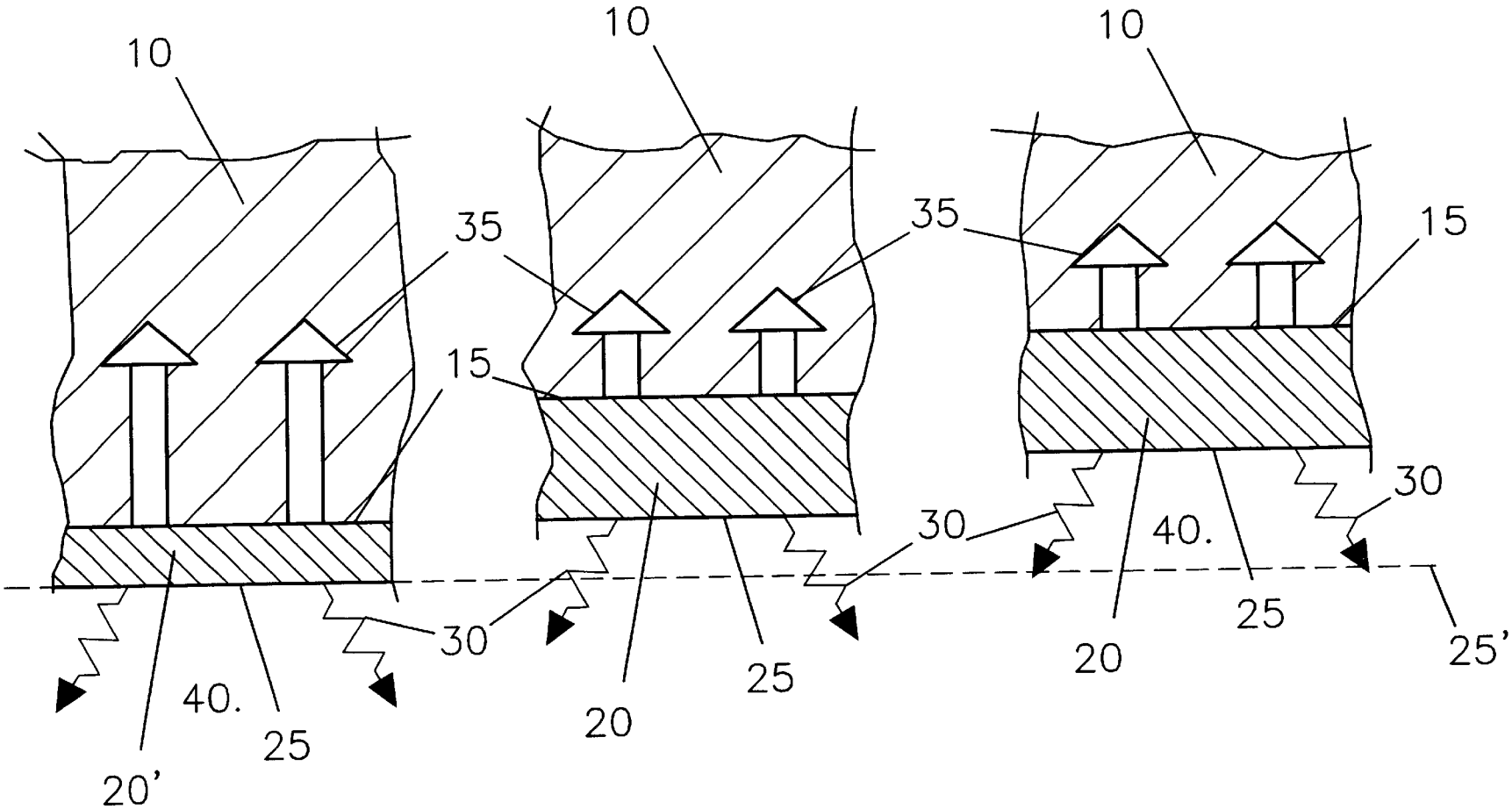
FIGS. 1(*a*), 1(*b*) and 1(*c*) are schematic representations of the evolution in time of an anode according to the invention with a self-formed oxide-based surface layer.

FIGS. 1(*a*), 1(*b*) and 1(*c*) show an anode comprising a metallic (un-oxidised) anode body 10 which is slowly consumed as a self-formed electrochemically active oxide-based surface layer 20 progresses according to the invention when the anode is anodically polarised in an electrolytic bath 40, such as a fluoride-based electrolyte 40 at about 950° C. containing 1 to 10% dissolved alumina in a cell for the electrowinning of aluminium. The anode for example comprises an alloy of iron with nickel, copper and/or cobalt which forms an oxide-based surface layer 20 containing ferrites.

FIG. 1(*a*) shows part of a pre-oxidised anode according to the invention shortly after its immersion into the electrolyte 40. In FIG. 1(*a*) the anode is in a transitional period during which the pre-oxidised surface layer 20' is grown from the metallic anode body 10 at the surface layer/anode body interface 15 at a faster rate than its dissolution 30 into the electrolyte 40 at the surface layer/electrolyte interface 25, thereby progressively increasing its thickness. The dashed line 25' shows the initial position of the surface layer/electrolyte interface 25 at or shortly after immersion of the anode into the electrolyte 40.

FIGS. 1(*b*) and 1(*c*) illustrate the situation where the anode has reached its steady state of operation. The oxide-based surface layer 20 has grown from its original thickness shown in FIG. 1(*a*) to its equilibrium thickness as shown in FIGS. 1(*b*) and 1(*c*). The rate of dissolution 30 of the surface layer 20 into the electrolyte 40 at the surface layer/electrolyte interface 25 is substantially equal to its rate of formation 35 at the surface layer/anode body interface 15, consuming the metallic anode body 10 at an equivalent rate. Furthermore, the surface layer/electrolyte interface 25 slowly withdraws from its initial position 25' while the oxide-based surface layer 20 is dissolved into the electrolyte 40.

Figure 2B:
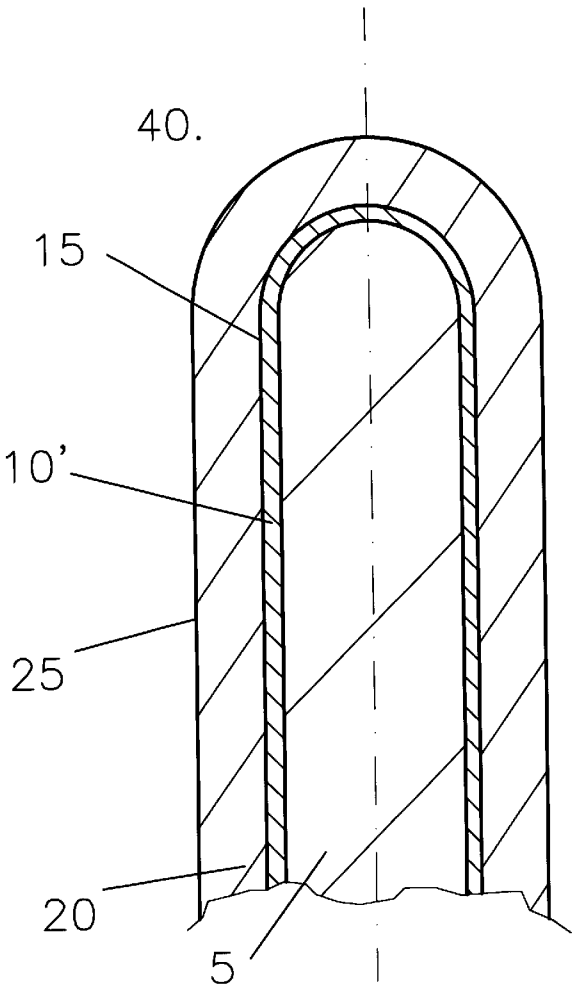
FIGS. 2(*a*) and 2(*b*) are schematic representations of the evolution in time of an anode similar to the anode shown in FIGS. 1(*a*), 1(*b*) and 1(*c*) which further comprises an inner metal core.
Figure 2A:
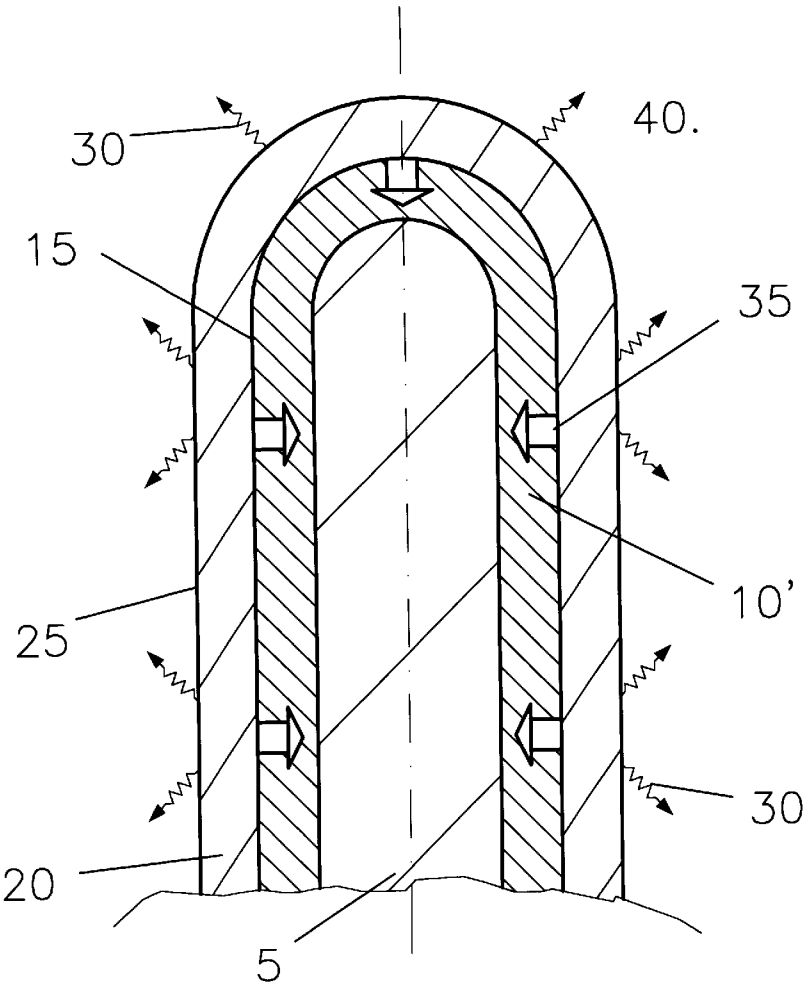

FIGS. 2(*a*) and 2(*b*) show an anode comprising an electronically conductive and oxidation resistant inner core 5, for instance nickel-based, supporting a metallic anode layer 10' having an electrochemically active oxide-based surface layer 20 as described previously.

FIG. 2(*a*) illustrates the oxide-based surface layer 20 grown from the metallic anode layer 10' at the surface layer/anode layer interface 15. The formation rate 35 of the surface layer is equal to its dissolution rate 30 into the electrolyte 40 as illustrated in FIGS. 1(*b*) and 1(*c*).

In FIG. 2(*b*), the oxide-based surface layer 20 has progressed until the metallic anode layer 10' covering the inner core 5 has been nearly completely consumed. Since the inner core 5 is resistant to oxidation, further dissolution 30 of the oxide-based surface layer is not replaced by oxidation of the inner core once the metallic anode layer 10' has worn away. The remaining surface layer 20 will slowly dissolve into the electrolyte 40 at the surface layer/electrolyte interface 25 and its thickness slowly decreases.

An anode having an oxidisable metallic anode layer 10' covering an inner core 5 may still remain in the electrolyte 40 after its metallic anode layer 10' is completely consumed, provided the inner core 5 is not fully passivated when exposed to oxygen, until the oxide-based surface layer 20 is too thin to allow the conversion of ionic oxygen to molecular oxygen. When this conversion is no longer possible the anode needs to be extracted and replaced or restored. However, the anode can be removed earlier if desired.

The invention will be further described in the following Examples.

EXAMPLE 1

A non-carbon metal-based anode according to the invention was obtained from a 15×15×80 mm sample of a nickel-iron based alloy. The sample was made of cast alloy consisting of 79 weight % nickel, 10 weight % iron and 11 weight % copper.

The sample was pre-oxidised in air at about 1100° C. for 5 hours in a furnace to form the anode with a pre-oxidised surface layer.

After pre-oxidation, the anode was immersed in molten cryolite contained in a laboratory scale cell. The molten cryolite contained approximately 6 weight % of dissolved alumina. Current was passed through the anode sample at a current density of 0.5 A/cm$^2$. After 100 hours, the anode was extracted from the cell for analysis.

The anode was crack-free and its dimensions remained substantially unchanged. On the surface of the anode a well adherent oxide surface layer of a thickness of about 0.6 mm had grown providing an adequate protection.

EXAMPLE 2

This Example illustrates the wear rate of the nickel-iron containing anode of Example 1 and is based upon observations made on dissolution of nickel-based samples in a fluoride-based electrolyte.

An estimation of the wear rate is made on the following parameters and assumptions:

With a current density of 0.7 A/cm$^2$ and a current efficiency of 94% an aluminium electrowinning cell produces daily 53.7 kg aluminium per square meter of active cathode surface.

Assuming a contamination of the produced aluminium by 200 ppm of nickel, which corresponds to the experimentally measured quantities in typical tests, the wear rate of a nickel-iron sample corresponds to approximately 1.2 micron/day. Therefore, it will theoretically take about 80 to 85 days to wear 0.1 mm of the anode.

EXAMPLE 3

A multi-layer, non-carbon, metal-based anode was prepared comprising a self-formed electrochemically-active outer oxide-based surface layer according to the invention.

The anode was made by coating by electro-deposition a structure in the form of an rod having a diameter of 12 mm consisting of 74 weight % nickel, 17 weight % chromium and 9 weight % iron, such as Inconel®, first with a nickel layer about 200 micron thick and then a copper layer about 100 micron thick by plasma spraying.

The coated structure was heat treated at 1000° C. in argon for 5 hours. This heat treatment provides for the interdiffusion of nickel and copper to form an intermediate protective layer. The structure was then heat treated for 24 hours at 1000° C. in air to form a chromium oxide ($Cr_2O_3$) barrier layer on the structure and oxidising at least partly the interdiffused nickel-copper layer thereby forming the intermediate layer, thereby forming an inner core for an anode according to the invention.

A further layer of a nickel-iron based alloy consisting of 79 weight % nickel, 10 weight % iron and 11 weight % copper of a thickness of about 1 to 2 mm was then applied on the inner core structure by plasma spraying.

This alloy layer was then pre-oxidised at 1100° C. for 5 hours for the formation of an electrochemically active oxide-based surface layer on the alloy layer. Although pre-oxidation of the alloy layer is preferred, the treatment is not necessary before using the anode in the cell to produce aluminium.

The anode was then tested in a cryolite melt containing approximately 6 weight % alumina at 970° C. by passing a current at a current density of about 0.8 A/cm$^2$.

The anode was extracted after 100 hours from the cryolite and showed no sign of significant internal corrosion after microscopic examination of a cross-section of the anode specimen as in Example 1.

During electrolysis the alloy layer was further oxidised at the alloy layer/surface layer interface, progressively forming the electrochemically active oxide-based surface layer according to the invention. Simultaneously, the oxide-based surface layer was slowly dissolved into the electrolyte at the surface layer/electrolyte interface at substantially the same rate as its rate of formation at the alloy layer/surface layer interface, thereby maintaining the thickness of the oxide-based surface layer substantially constant, as the alloy layer wore away.

What is claimed is:

1. A non-carbon, metal-based slow-consumable anode of a cell for the electrowinning of aluminium by the electrolysis of alumina dissolved in a molten fluonrde-based electrolyte, such anode having a metallic anode body that self-forms during normal electrolysis an electrochemically-active oxide-based surface layer, the rate of formation of said layer at the surface layer/anode body interface being substantially equal to its rate of dissolution at the surface layer/electrolyte interface thereby maintaining its thickness substantially constant forming a limited barrier controlling the oxidation rate.

2. The anode of claim 1, which comprises an iron-containing alloy which is oxidised at least partly into a ferrite to form the surface layer.

3. The anode of claim 2, which comprises an alloy of iron with at least one of nickel, copper, cobalt or zinc.

4. The anode of claim 2, wherein said alloy further comprises at least one additive selected from beryllium, magnesium, yttrium, titanium, zirconium, vanadium, niobium, tantalum, chromium, molybdenum, tungsten, manganese, rhodium, silver, aluminium, silicon, tin, hafnium, lithium, cerium and other Lanthanides.

5. The anode of claim 4, wherein said alloy comprises cerium which is oxidised to ceria in the formation of the oxide-based surface layer to provide on the surface of the layer a nucleating agent for the in-situ formation of an electrolyte-generated protective layer.

6. The anode of claim 1, wherein the oxide-based surface layer is coated with a protective coating of cerium oxyfluoride, formed in-situ in the cell or pre-applied.

7. The anode of claim 1, wherein the oxide-based surface layer comprises ceramic oxides containing combinations of divalent nickel, cobalt, magnesium, manganese, copper and zinc with divalent/trivalent nickel, cobalt, manganese and/or iron.

8. The anode of claim 7, wherein said ceramic oxides are in the form of perovskites or non-stoichiometric and/or partially substituted or doped spinels, the doped spinels further comprising dopants selected from the group consisting $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$and $Li^{+}$.

9. The anode of claim 1, comprising a metallic anode body or layer which progressively forms the oxide-based surface layer on an electronically conductive, inert, inner core.

10. The anode of claim 9, wherein the inner core is selected from metals, alloys, intermetallic compounds, cermets and conductive ceramics or combinations thereof.

11. The anode of claim 10, wherein the inner core comprises at least one metal selected from copper, chromium, nickel, cobalt, iron, aluminium, hafnium, molybdenum, niobium, silicon, tantalum, tungsten, vanadium, yttrium and zirconium, and combinations and compounds thereof.

12. The anode of claim 11, wherein the inner core is an alloy comprising 10 to 30 weight % of chromium, 55 to 90 weight % of at least one of nickel, cobalt and/or iron and 0 to 15 weight % of at least one of aluminium, hafnium, molybdenum, niobium, silicon, tantalum, tungsten, vanadium, yttrium and zirconium.

13. The anode of claim 9, wherein the inner core is covered with an oxygen barrier layer.

14. The anode of claim 13, wherein the oxygen barrier layer comprises chromium oxide.

15. The anode of claim 14, wherein the oxygen barrier layer comprises black non-stoichiometric nickel oxide.

16. The anode of claim 13, wherein the oxygen barrier layer is covered with at least one protective layer consisting of copper or copper and at least one of nickel and cobalt, and/or oxides thereof to protect the oxygen barrier layer by inhibiting its dissolution into the electrolyte.

17. The anode of claim 1, whose surface is pre-oxidised prior to normal electrolysis.

18. The anode of claim 17, wherein after its introduction into and before normal operation in the cell the rate of formation of the oxide-based surface layer is initially smaller than its rate of dissolution, thereby decreasing the thickness of the surface layer.

19. The anode of claim 17, wherein after its introduction into and before normal operation in the cell the rate of formation of the oxide-based surface layer is initially greater than its rate of dissolution, thereby increasing the thickness of the surface layer.

20. A cell for the electrowinning of aluminium by the electrolysis of alumina dissolved in a molten fluoride-containing electrolyte comprising at least one anode according to claim 1 which during normal electrolysis is oxidised, self-forming the electrochemically active oxide-based surface layer.

21. The cell of claim 20, comprising at least one aluminium-wettable cathode.

22. The cell of claim 21, which is in a drained configuration.

23. The cell of claim 21, comprising at least one drained cathode on which aluminium is produced and from which aluminium continuously drains.

24. The cell of claim 21, which is in a bipolar configuration and wherein the anodes form the anodic side of at least one bipolar electrode and/or a terminal anode.

25. The cell of claim 21, comprising means to circulate the electrolyte between the anodes and facing cathodes and/or means to facilitate dissolution of alumina in the electrolyte.

26. The cell of claim 20, wherein during operation the electrolyte is at a temperature of 700° C. to 970° C.

27. A method of operating a cell for the electrowinning of aluminium by the electrolysis of alumina dissolved in a molten fluoride-containing electrolyte, the cell comprising at least one metal-based anode having a metallic anode body that self-forms during normal electrolysis an electrochemically-active oxide-based surface layer which dissolves in the electrolyte, the method comprising dissolving alumina in the electrolyte, self-forming on the anode(s) an electrochemically active oxide-based surface layer, the rate of formation of said layer at the surface layer/anode body interface being substantially equal to its rate of dissolution at the surface layer/electrolyte interface, and electrolyzing the alumina-containing electrolyte to evolve oxygen on the or each electrochemically active surface layer and cathodically produce aluminium.

28. The method of claim 27, wherein the anode is in-situ pre-oxidised prior to its immersion into the electrolyte.

29. The method of claim 27, wherein the anode is replaced when worn or necessary with a new anode or a restored anode.

* * * * *